United States Patent [19]

Chiappetta et al.

[11] Patent Number: 4,662,518

[45] Date of Patent: May 5, 1987

[54] LOTTA LUCK LOTTERY KIT

[76] Inventors: Peggy L. Chiappetta; Brenda S. Maggio, both of 612 Porter La., Hermosa Beach, Calif. 90254

[21] Appl. No.: 804,520

[22] Filed: Nov. 25, 1985

[51] Int. Cl.[4] ..... B65D 85/62; A45C 11/18

[52] U.S. Cl. ..... 206/449; 206/39; 206/39.1; 206/39.3; 206/230; 206/579

[58] Field of Search ..... 206/39, 39.1, 39.3, 206/230, 234, 457, 579; D19/6, 7; D32/46; 30/124, 169

[56] References Cited

U.S. PATENT DOCUMENTS

| | | | |
|---|---|---|---|
| D. 233,586 | 11/1974 | Kopp | D32/46 |
| 859,000 | 7/1907 | Marsh | 206/39 |
| 1,717,801 | 6/1929 | Metcalf | 206/39 |
| 2,824,394 | 2/1958 | Lolhes | D19/6 |
| 3,855,698 | 12/1974 | Crosby | 30/124 |
| 3,908,887 | 9/1975 | Leto | 30/169 |
| 4,077,515 | 3/1978 | Shoberg | 206/456 |
| 4,176,861 | 12/1979 | MacKiernan, Jr. | 206/39 |
| 4,438,767 | 3/1984 | Nelson | 30/169 |

FOREIGN PATENT DOCUMENTS

| | | | |
|---|---|---|---|
| 1560591 | 2/1969 | France | 206/540 |
| 2436580 | 5/1980 | France | 206/39 |
| 238207 | 8/1925 | United Kingdom | 206/39 |

*Primary Examiner*—William Price
*Assistant Examiner*—Brenda J. Ehrhardt

[57] ABSTRACT

The invention is designed to use with lottery tickets. It includes a container to hold at least ten lottery tickets. The container houses a scraper designed to remove the coating from the tickets, a protective lip which covers the "void if removed" section of the ticket, and a slot to allow for easy disposal of the residue coating through the bottom of the container.

3 Claims, 7 Drawing Figures

LOTTA LUCK LOTTERY KIT

BACKGROUND OF INVENTION

1. Field of Invention

This invention is a kit consisting of a plastic container and scraper made to be used with lottery tickets, sold in over twenty states.

The kit has been designed to make the steps necessary to play an "instant" or "scratch off" lottery ticket more convenient for the player.

It allows the user to store up to ten tickets in the container and scrape the coating off the tickets easily while held in the container. The container catches the residue coating, which can then be disposed of.

This invention also prevents the user from accidentally removing the coating on a ticket, which would render a winning ticket void.

2. Prior Art

Various containers as disclosed in U.S. Pat. Nos. 859,000, 1,717,801, 2,824,394, 3,855,698, 3,908,887, 4,077,515, 4,176,861. And International Pat. Nos. 238,707, 1,560,591, 2,436,580 have heretofore been provided for holding cards, medical slides, and ski lift or subway style tickets.

However, such prior containers are not designed to be used to hold lottery tickets which are played by scraping off a coating on the ticket.

This invention includes a container made for use with this type of lottery ticket and has a protective lip built into the bottom to prevent the player from removing the "Void If Removed" coating on the ticket.

Also, scraping type utensils have been previously provided, as disclosed in U.S. Pat. Nos. Des. 233,586 and 4,438,767. One of these scrapers is made to be used on human skin.

Such previous scraping utensils have not been shown in a shape or size that would serve the purpose required by the scraper included in the container, which makes up the kit.

This scraper is designed, specifically in a size and shape, to be used to scrape the coating off of the "scratch off" type of lottery game ticket.

SUMMARY

The invention is designed to make the scraping off of the coating on the the ticket to determine it's status as a winning or a losing ticket more convenient for the person using the ticket.

The invention includes a lip which holds the ticket in place in a container while it is being scraped.

The same lip in the container also covers the "void if removed" section found on most lottery tickets, preventing the user from accidentally scraping any coating from this section. If the above mentioned section is accidentally removed it generally renders a winning ticket worthless, as the state will not honor them.

The container is designed to allow the user to hold at least ten tickets in the container, to save them or add them in the kit to be given as a gift.

The design of the kit includes a small slot in the bottom of the container through which the residue coating scraped off a ticket can be easily and neatly disposed of.

The kit also contains a scraper (shown in the included drawings as a clover shaped scraper, but will be produced in various shapes) designed specifically to scrape the coating off the lottery tickets easily.

The container which houses the other parts and designs that comprise the lottery kit, along with the scraper, will originally (as according to the included drawings) be produced by the process of plastic injection molding. However the lottery kit will also be made with other materials, with the design and function as described herein remaining the same.

The sizes and dimensions in the included drawings required for patent examination are those to be used to produce lottery kits for the size of California lottery tickets. The size and dimensions will vary according to the various different sizes of lottery tickets. The dimensions may differ within two inches, however the design as included with this application will remain the same, changing only in size to accomadate the tickets. The function of the kit will remain the same.

DETAILED DESCRIPTION OF THE DRAWINGS

Figure 7:
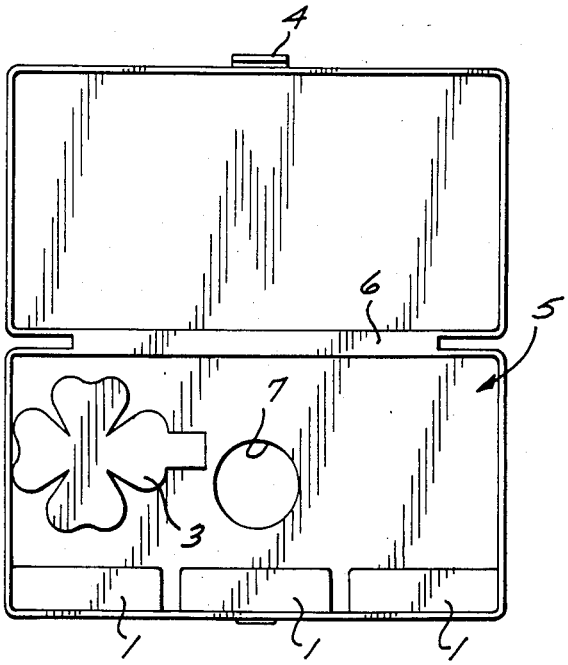
FIG. 7: A top view of the kit shown in the open position.
Figure 6:
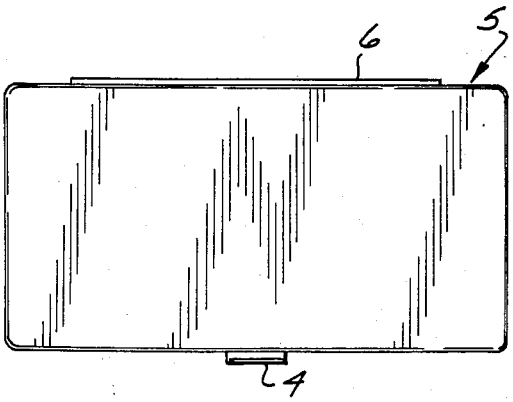
FIG. 6: A top view of the kit.

1. Protective Lip—Shown in FIG. 7. Secures the void if removed section of a lottery ticket from accidental removal, and holds the ticket in place for scraping.

Figure 1:
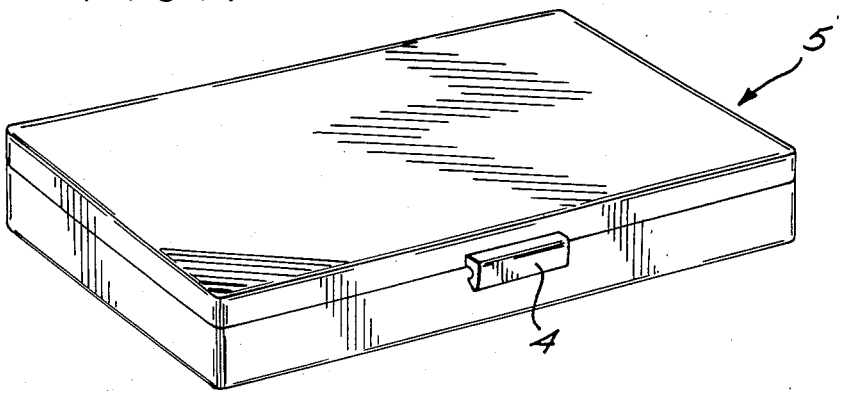
FIG. 1: A perspective view of the invention.
Figure 2:
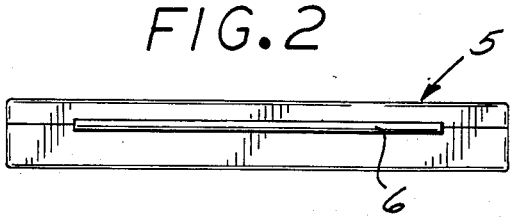
FIG. 2: A rear view of the kit.
Figure 3:
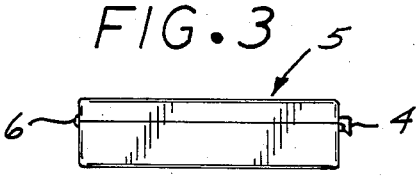
FIG. 3: A side view of the kit.
Figure 4:
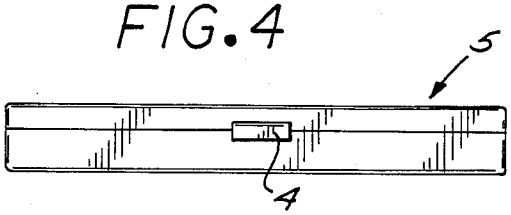
FIG. 4: A front view of the kit.
Figure 5:
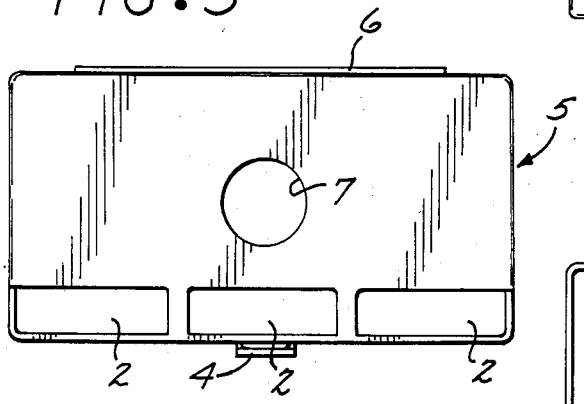
FIG. 5: A bottom view of the kit.

2. Open Slot—Shown in FIG. 5. Used to empty the container of the residue coating left after the scraping of a ticket.

3. Scraper—Shown in FIG. 7. A tool specifically designed to be used to scrape th coating off the appropriate spaces on lottery tickets.

4. Latches—Shown in FIGS. 1, 3, 4, 5, 6, and 7. To keep the container of the kit closed when it is not being used.

5. Container—Shown in FIGS. 1, 2, 3, 4, 5, 6, and 7. A rectangular shaped container which inclues the lip (1), the open slot (2), the circular opening (7), and contains the scraper (3) to make up the kit.

6. Living Hinge—Shown in FIGS. 2, 3, 5, 6, and 7. Connects the top and bottom of the container.

7. Circular Opening—Shown in FIGS. 5 and 7. Finger sized opening used to push tickets out of the kit for easy removal.

We claim:

1. A kit, to be used with "scratch off" type lottery game tickets, comprised of a rectangular shaped plastic container produced in one piece with the bottom and lid attached by a living hinge, a lip located on an edge of the bottom of the container and constructed so as to hold the tickets in place and act as a protective covering for the void-if-removed section on many tickets, an opening or slot in the underside of the container, and a small plastic scraper to be included in the container.

2. The kit of claim 1 wherein said rectangular shaped plastic box is adapted to hold up to ten tickets and has a latch to snap the container closed, said lip at the bottom is adapted to hold lottery tickets in place for scraping, and said opening or slot in the underside is located beneath the lip to allow for easy removal of the debris left after using the kit.

3. The kit of claim 1, wherein said small plastic scraping tool is designed with one flat edge sized to be utilized for scraping the coating off on the "scratch off" type lottery tickets, and may be produced in various decorative shapes.

* * * * *